US007059133B2

(12) United States Patent
Gerendas

(10) Patent No.: US 7,059,133 B2
(45) Date of Patent: Jun. 13, 2006

(54) DILUTION AIR HOLE IN A GAS TURBINE COMBUSTION CHAMBER WITH COMBUSTION CHAMBER TILES

(75) Inventor: Miklos Gerendas, Zossen (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 56 days.

(21) Appl. No.: 10/400,553

(22) Filed: Mar. 28, 2003

(65) Prior Publication Data

US 2003/0182942 A1 Oct. 2, 2003

(30) Foreign Application Priority Data

Apr. 2, 2002 (DE) ..... 102 14 570

(51) Int. Cl.
*F02C 1/00* (2006.01)
*F02G 3/00* (2006.01)

(52) U.S. Cl. ..... 60/752; 60/753

(58) Field of Classification Search ..... 60/752, 60/753, 754, 755, 757
See application file for complete search history.

(56) References Cited

U.S. PATENT DOCUMENTS 4,441,324 A * 4/1984 Abe et al. ..... 60/753
4,446,693 A * 5/1984 Pidcock et al. ..... 60/800
5,687,572 A * 11/1997 Schrantz et al. ..... 60/753
6,170,266 B1 1/2001 Pidcock et al.
6,408,628 B1 * 6/2002 Pidcock et al. ..... 60/752
6,606,861 B1 8/2003 Snyder
6,708,499 B1 * 3/2004 Pidcock et al. ..... 60/796
2002/0056277 A1 * 5/2002 Parry ..... 60/752
2003/0145604 A1 * 8/2003 Pidcock et al. ..... 60/796
2004/0006995 A1 * 1/2004 Snyder ..... 60/796

FOREIGN PATENT DOCUMENTS

| | | |
|---|---|---|
| EP | 0937946 | 8/1999 |
| EP | 1235032 | 8/2002 |
| GB | 2353589 | 2/2001 |

OTHER PUBLICATIONS

German Search Report dated Apr. 2, 2002.

* cited by examiner

*Primary Examiner*—Justine R. Yu
*Assistant Examiner*—William H. Rodriguez
(74) *Attorney, Agent, or Firm*—Harbin King & Klima

(57) ABSTRACT

A gas turbine combustion chamber includes combustion chamber tiles 3 attached to a supporting structure 6 of the gas turbine combustion chamber, with each tile possessing at least one dilution air hole 4 which is flush with a dilution air hole of the supporting structure 6, wherein a diameter of the dilution air hole of the supporting structure 6 is considerably larger than a diameter 14 of the dilution air hole 4 of the combustion chamber tile 3.

24 Claims, 4 Drawing Sheets

DILUTION AIR HOLE IN A GAS TURBINE COMBUSTION CHAMBER WITH COMBUSTION CHAMBER TILES

This application claims priority to German Patent Application DE10214570.9 filed Apr. 2, 2002, the entirety of which is incorporated by reference herein.

BACKGROUND OF THE INVENTION

This invention relates to a gas turbine combustion chamber with combustion chamber tiles, in which the combustion chamber tiles are attached to a supporting structure of the gas turbine combustion chamber, each tile possessing at least one dilution air hole which is flush with a dilution air hole of the supporting structure.

As is known from the state of state of the art, tiles are used on gas turbine combustion chambers to protect the supporting and sealing structure against the intense heat irradiation of the flame. Thus, the supporting structure is kept relatively cool and retains its mechanical strength. Accordingly, dilution air must be passed from the outside from an annulus through a dilution air hole in the supporting structure and through a dilution air hole in the combustion chamber tile to the inside into the combustion chamber.

Such designs are known from Specifications U.S. Pat. No. 6,145,319 or EP 972 992 A2, for example.

In the designs according to the state of the art, the diameter of the dilution air hole of the supporting structure (tile carrier) is maximally slightly larger than the diameter of the dilution air hole of the combustion chamber tile. In the state of the art, the only purpose of this dimensional difference is to ensure that the rim of the dilution air hole of the supporting structure does not protrude beyond the rim of the dilution air hole of the combustion chamber tile under the most adverse combination of all manufacturing and assembly tolerances.

If a gap occurs between the tile rim and the supporting structure in operation, quite a considerable amount of cooling air will leak through this gap due to the large pressure difference between the tile interior and the dilution air hole.

In order to avoid premature failure of the combustion chamber tile by the resultant overheating, the amount of cooling air through the combustion chamber tile must be increased significantly. Accordingly, this additional cooling air is no longer available for improving fuel preparation and the associated reduction of nitrogen oxide emission.

BRIEF SUMMARY OF THE INVENTION

In a broad aspect, the present invention provides a gas turbine combustion chamber with combustion chamber tiles of the type specified above which is characterized by longevity and which is capable of avoiding overheating of the entire assembly, while being simply designed, easily and cost-effectively produced and conveniently assembled.

It is a particular object of the present invention to provide solution to the above problem by the combination of the features described herein, with other objects and advantages of the present invention being described below.

Accordingly, the present invention provides for a notably larger diameter of the dilution air hole of the supporting structure compared with the diameter of the dilution air hole of the combustion chamber tile.

The arrangement according to the present invention is characterized by a variety of merits.

According to the present invention, the ratio of the diameters is selected such that the tile rim, as viewed from the outside of the supporting structure, protrudes considerably into the free diameter of the dilution air hole. Thus, a dynamic pressure is produced on the thickened tile rim. Also, the flow coefficient of the dilution air hole is increased. If a gap between the tile rim and the supporting structure occurs in operation, the above dynamic pressure will counteract the leakage of cooling air from the tile interior. If the diameter of the dilution air hole of the supporting structure is selected appropriately, the dynamic pressure on the tile rim will be equal to the pressure in the tile interior. Thus, leakage of cooling air from the tile interior will be avoided completely.

In accordance with the present invention, the strong dynamic pressure onto the thickened rim of the combustion chamber tile obtained by appropriate adjustment of the diameter of the dilution air hole of the supporting structure and the diameter of the dilution air hole of the combustion chamber tile enables additional cooling air to flow from the dilution air hole to the tile interior and the cooling of the combustion chamber tile to be intensified, if a gap develops between the combustion chamber tile and the supporting structure as a result of overheating of the tile.

The present invention accordingly provides for adaptive cooling, by virtue of which the cooling air quantity is automatically adjusted to the thermal load of the combustion chamber tile.

According to the present invention, the thickened rim of the combustion chamber tile is cooled by a separate pattern of effusion holes. These effusion holes can start on the rear of the surface of the combustion chamber tile or in the tile rim, and their entry can be situated on the side facing the tile interior or on the side facing the supporting structure. The effusion holes end on the surface of the combustion chamber tile or on the inner side of the dilution air hole of the combustion chamber tile. The effusion holes can extend to the hot-gas side of the combustion chamber tile with or without a circumferential component around the axis of the dilution air hole.

Accordingly, the cooling air quantity in the initial state of the gas turbine combustion chamber can be selected such that it is just sufficient for normal operation. Thus, the maximum air quantity is available for pollutant reduction. In extreme situations, in which the combustion chamber tile is subjected to higher thermal loads, cooling will automatically be increased, thus providing for longevity and safety of operation.

BRIEF DESCRIPTION OF THE DRAWINGS

This invention is more fully described in the light of the accompanying drawing showing a preferred embodiment. In the drawings.

DETAILED DESCRIPTION OF THE INVENTION

This detailed description should be read in conjunction with the summary above, which is incorporated by reference in this section.

Figure 1:
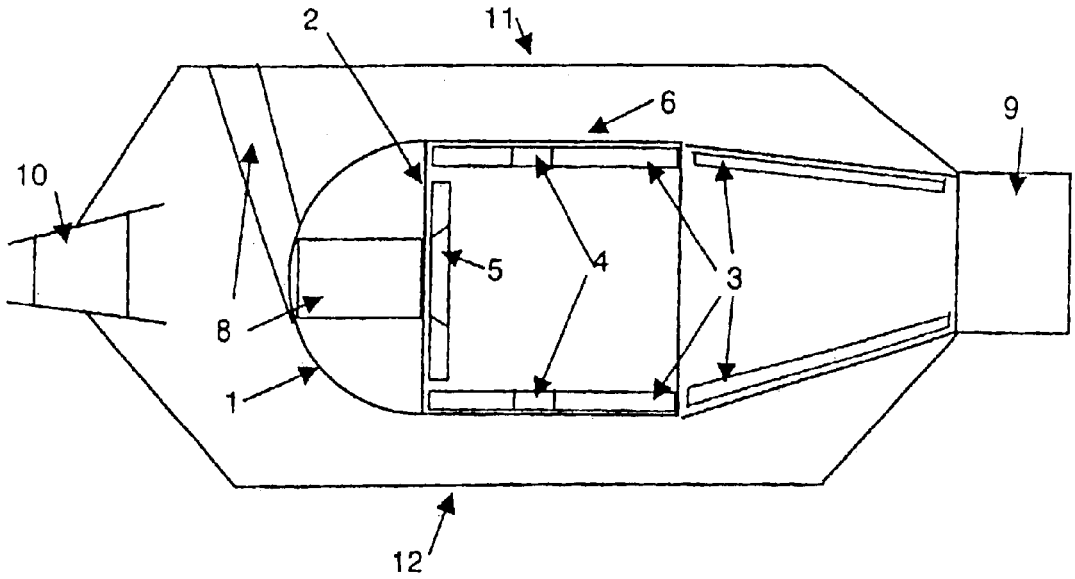
FIG. 1 is a schematic side view of a gas turbine combustion chamber with combustion chamber tiles according to the state of the art.

FIG. 1 shows a schematic sectional side view of a gas turbine combustion chamber according to the state of the art. Here, a hood 1 of a combustion chamber head is shown. Reference numeral 2 indicates a base plate, while reference numeral 3 designates combustion chamber tiles. The combustion chamber tiles 3 include dilution air holes 4 and are attached to a supporting structure 6. Reference numeral 5 indicates a heat shield with an opening for a burner 8. At the exit of the combustion chamber, a turbine nozzle guide vane 9 is shown in schematic representation. Reference numeral 10 indicates a guide vane at the compressor exit. A combustion chamber outer casing 11 and a combustion chamber inner casing 12 enclose the combustion chamber.

Figure 2A:
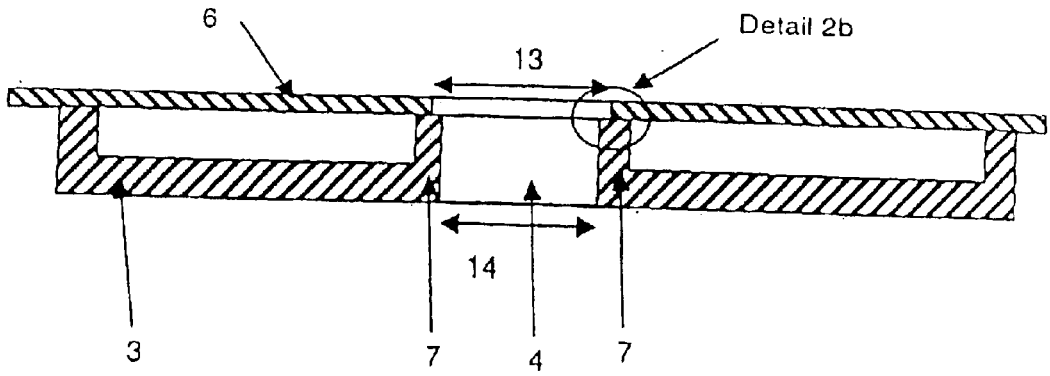
Fig. 2a (Prior Art)
FIG. 2*a* is a sectional view of a combustion chamber tile according to the state of the art.
Figure 2B:
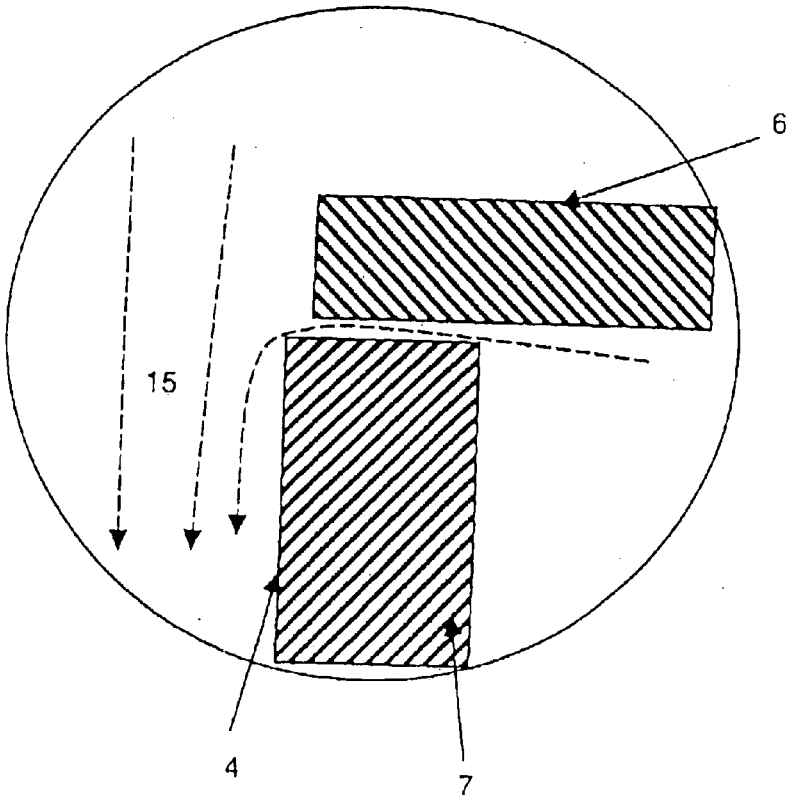
Fig. 2b (Prior Art)
FIG. 2*b* is a detail view of the detail 2*b* in FIG. 2*a*.

FIGS. 2*a* and 2*b* show the form of a dilution air hole 4 of the combustion chamber tile 3 and of a corresponding dilution air hole of the supporting structure 6 according to the state of the art. Obviously, the diameter 13 of the dilution air hole of the supporting structure 6 is slightly larger than the diameter 14 of the dilution air hole 4 of the combustion chamber tile 3. As becomes apparent from FIG. 2*b*, the airflow 15 in the dilution air hole 4 draws additional air from the tile interior.

Figure 3A:
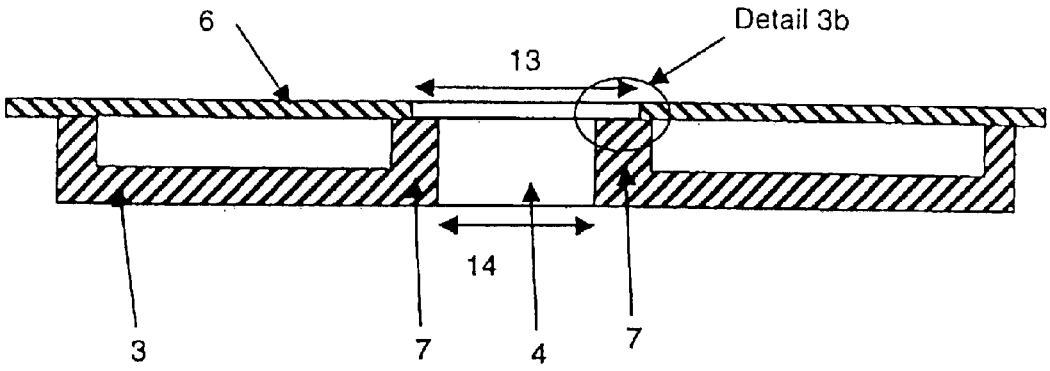
FIG. 3*a* is a sectional view, analogically to FIG. 2*a*, of a form of a combustion chamber tile according to the present invention.
Figure 3B:
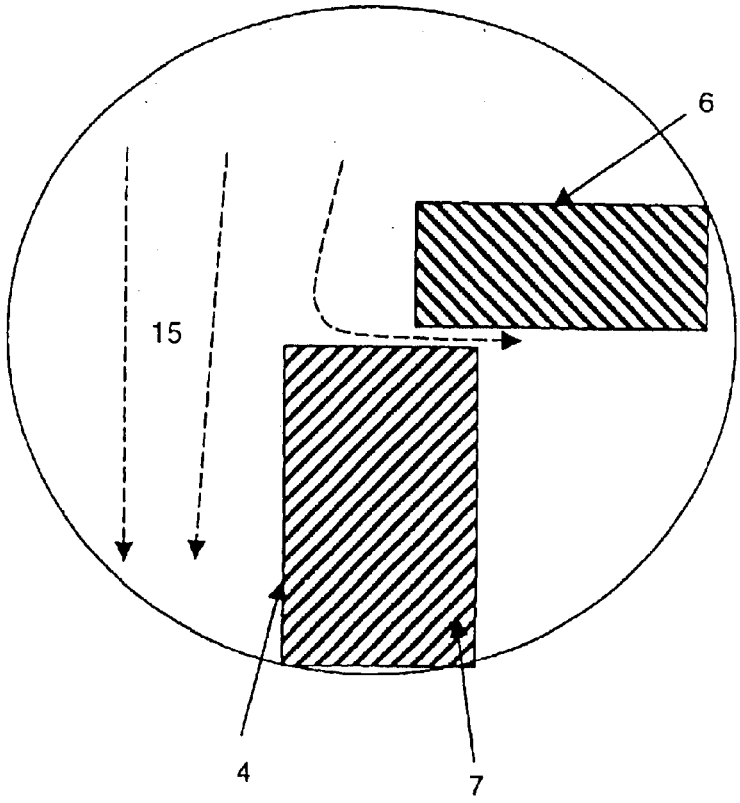
FIG. 3*b* is a detail view of the detail 3*b* in FIG. 3*a*.

FIGS. 3*a* and 3*b* show the design according to the present invention, analogically to FIGS. 2*a* and 2*b*. Obviously, the diameter 13 of the dilution air hole of the supporting structure 6 is notably or considerably larger than the diameter 14 of the dilution air hole 4 of the combustion chamber tile 3. As becomes apparent from FIG. 3*b*, the difference in the diameters 13 and 14 is sufficiently large to create a dynamic pressure in the airflow 15, this dynamic pressure producing a flow of cooling air into the tile interior if a gap forms between the supporting structure 6 and the tile rim 7 and/or increasing the flow of cooling air into the tile interior as the gap grows between the supporting structure 6 and the tile rim 7.

In one embodiment, the diameter of the dilution air hole of the supporting structure 6 is 15 percent to 25 percent larger than the diameter 14 of the dilution air hole 4 of the combustion chamber tile 3. In an alternative embodiment, the diameter of the dilution air hole of the supporting structure 6 is more than 25 percent larger than the diameter of the dilution air hole of the combustion chamber tile 3. The diameter of the dilution air hole of the supporting structure 6 can also be less than 15 percent larger than the diameter 14 of the dilution air hole 4 of the combustion chamber tile 3 as long as the desired effect discussed above is achieved.

Figure 4A:
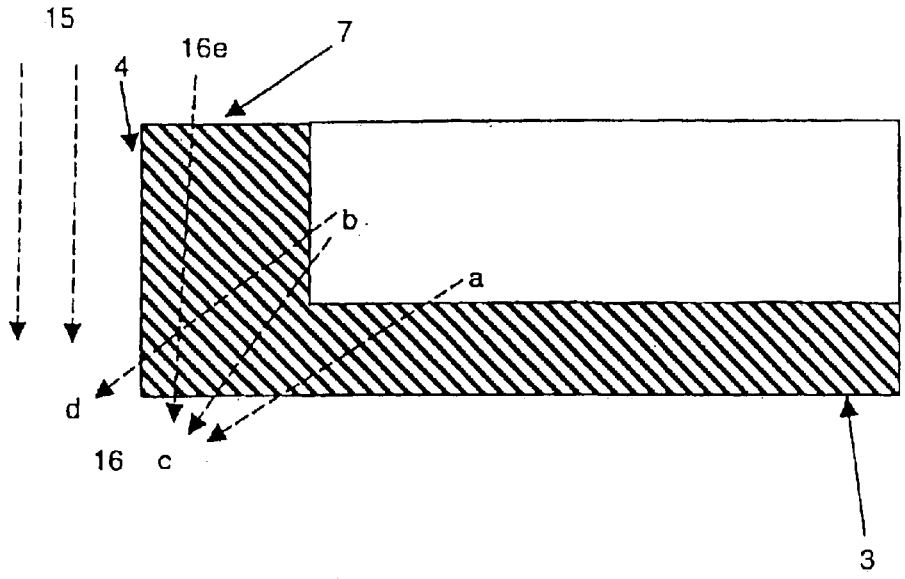
FIG. 4*a* is a detailed representation of the combustion chamber tile rim analogically to the FIG. 3*a*, and FIGS. 4*b* and 4*c* are representations of the rim area of a dilution air hole according to the present invention in top view, with different arrangements of effusion holes being shown.

FIG. 4*a* shows, in enlarged representation, a partial area of a combustion chamber tile 3 according to the present invention. Obviously, additional effusion holes 16 are provided through the tile rim 7 in the area of the dilution air hole 4 to supply cooling air from the tile interior for the cooling of the combustion chamber tile 3. The effusion holes 16 can have various directions relative to the plane of the combustion chamber tile 3. The effusion hole 16*a–c* is orientated at a very shallow angle, while the effusion holes 16*b–c* and 16*b–d* extend through the tile rim 7 and are orientated at a larger angle to the main plane of the combustion chamber tile 3. The effusion hole 16*e–c* extends nearly vertically to the main plane of the combustion chamber tile 3 and passes through the tile rim 7.

Figure 4B:
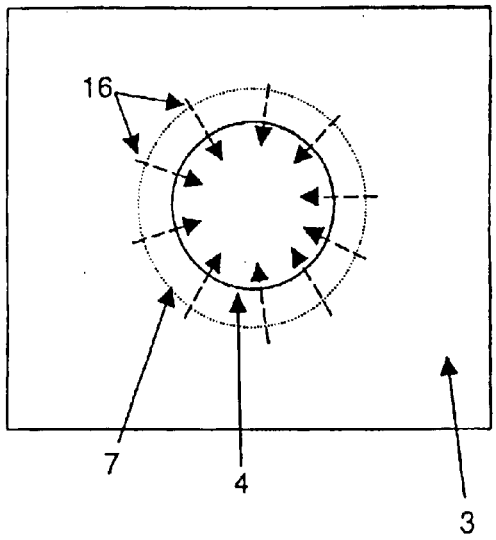
Figure 4C:
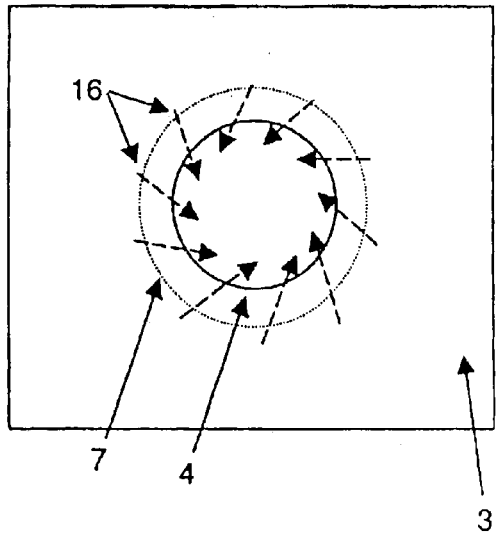

FIGS. 4*b* and 4*c* show two variants of the effusion holes 16 in top view of the dilution air hole 4 of the combustion chamber tile 3. In FIG. 4*b*, the effusion holes are all arranged radially (independently of the respective angle of inclination according to FIG. 4*a*), while an additional angular or tangential component around the axis of the dilution air hole, or an angular or tangential arrangement of effusion holes 16, is realized in FIG. 4*c*. This arrangement provides for particularly efficient cooling.

It is apparent that modifications other than described herein may be made to the embodiments of this invention without departing from the inventive concept.

What is claimed is:

1. A gas turbine combustion chamber, comprising:

a supporting structure including a plurality of dilution air holes; and a plurality of combustion chamber tiles attached to the supporting structure, at least one of the combustion chamber tiles including at least one dilution air hole which is flush with one of the dilution air holes of the supporting structure;

wherein, a diameter of the dilution air hole of the supporting structure is sufficiently larger than a diameter of the dilution air hole of the combustion chamber tile so as to produce a flow of cooling air from the supporting structure dilution air hole into a tile interior when a gap forms between the supporting structure and the combustion chamber tile at the diluton air hole.

2. A gas turbine combustion chamber in accordance with claim 1, wherein the diameter of the dilution air hole of the supporting structure is 15 percent to 25 percent larger than the diameter of the dilution air hole of the combustion chamber tile.

3. A gas turbine combustion chamber in accordance with claim 2, wherein the combustion chamber tile includes a tile rim and the combustion chamber tile is not sealed at a location of its tile rim on the supporting structure.

4. A gas turbine combustion chamber in accordance with claim 3, wherein a gap can form between supporting structure and the tile rim.

5. A gas turbine combustion chamber in accordance with claim 4, wherein the combustion chamber tile includes a plurality of effusion holes which connect to the tile interior.

6. A gas turbine combustion chamber in accordance with claim 5, wherein the effusion holes are provided in the tile rim.

7. A gas turbine combustion chamber in accordance with claim 6, wherein the effusion holes are arranged radially to the dilution air hole.

8. A gas turbine combustion chamber in accordance with claim 6, wherein the effusion holes are arranged tangentially to the dilution air hole.

9. A gas turbine combustion chamber in accordance with claim 6, wherein the effusion holes have both a radial and a tangential component relative to an axis of the dilution air hole.

10. A gas turbine combustion chamber in accordance with claim 5, wherein the effusion holes are provided outside of the tile rim.

11. A gas turbine combustion chamber in accordance with claim 10, wherein the effusion holes are arranged radially to the dilution air hole.

12. A gas turbine combustion chamber in accordance with claim 10, wherein the effusion holes are arranged tangentially to the dilution air hole.

13. A gas turbine combustion chamber in accordance with claim 10, wherein the effusion holes have both a radial and a tangential component relative to an axis of the dilution air hole.

14. A gas turbine combustion chamber in accordance with claim 1, wherein the combustion chamber tile includes a tile rim and the combustion chamber tile is not sealed at a location of its tile rim on the supporting structure.

15. A gas turbine combustion chamber in accordance with claim 1, wherein the combustion chamber tile includes a plurality of effusion holes which connect to a tile interior.

16. A gas turbine combustion chamber in accordance with claim 15, wherein the effusion holes are provided in the tile rim.

17. A gas turbine combustion chamber in accordance with claim 16, wherein the effusion holes are arranged radially to the dilution air hole.

18. A gas turbine combustion chamber in accordance with claim 16, wherein the effusion holes are arranged tangentially to the dilution air hole.

19. A gas turbine combustion chamber in accordance with claim 16, wherein the effusion holes have both a radial and a tangential component relative to an axis of the dilution air hole.

20. A gas turbine combustion chamber in accordance with claim 15, wherein the effusion holes are provided outside of the tile rim.

21. A gas turbine combustion chamber in accordance with claim 20, wherein the effusion holes are arranged radially to the dilution air hole.

22. A gas turbine combustion chamber in accordance with claim 20, wherein the effusion holes are arranged tangentially to the dilution air hole.

23. A gas turbine combustion chamber in accordance with claim 20, wherein the effusion holes have both a radial and a tangential component relative to an axis of the dilution air hole.

24. A gas turbine combustion chamber in accordance with claim 1, wherein the diameter of the dilution air hole of the supporting structure is greater than 25 percent larger than the diameter of the dilution air hole of the combustion chamber tile.

* * * * *